United States Patent [19]

Wosje

[11] Patent Number: 4,728,280

[45] Date of Patent: Mar. 1, 1988

[54] CHIMNEY LINING SLIP FORM

[76] Inventor: Michael J. Wosje, 1100 S. 2nd Ave., Sioux Falls, S. Dak. 57105

[21] Appl. No.: 904,621

[22] Filed: Sep. 8, 1986

[51] Int. Cl.[4] ..... B05C 17/08; B05C 17/06; B28B 1/29

[52] U.S. Cl. ..... 425/460; 29/527.1; 425/110; 425/262

[58] Field of Search ..... 29/527.1; 15/104 R; 118/105; 425/110, 262, 460

[56] References Cited

U.S. PATENT DOCUMENTS

| | | | |
|---|---|---|---|
| 126,100 | 4/1872 | Stephens | 425/460 |
| 2,555,377 | 6/1951 | Scott | 425/460 X |
| 2,711,000 | 6/1955 | Matheny | 425/460 |
| 3,096,556 | 7/1963 | Woods | 425/262 |

*Primary Examiner*—Howard N. Goldberg
*Assistant Examiner*—Ronald S. Wallace

[57] ABSTRACT

An apparatus for lining chimney pipes and the like with cementitious material, and particularly to the improvement in pipe lining apparatus including a conically shaped leading nose providing control switches activated by a nose cap freely positioned thereover, and a gradually rearwardly tapered hollow sectional trailing spreader body adjusted to be circumferentially enlarged by additional expansion panels connected between the separable sections of the spreader body, and a vibrator within the body to exert vibrative force on the body sections to set the cementitious material deposited externally of the apparatus between it and the chimney pipe to be lined thereby.

12 Claims, 5 Drawing Figures

CHIMNEY LINING SLIP FORM

BACKGROUND OF THE INVENTION

It is required in many pipe lining operations to provide in an apparatus for lining pipe with cementitious material a means for adjusting the periphery of the apparatus so that the same may be readily adjusted for use in pipes of various diameters.

Prior endeavors have been directed to effecting circumference change only in a protion of the apparatus, such as by expanding flexible tail sections such as disclosed in U.S. Pat. No. 2,555,377.

Toggle-like expansion joints were used to spread overlapping edges of a section cylinder body such as is illustrated in U.S. Pat. No. 126,100.

A neck made of flexible material such as rubber, was employed to permit the flexing of the side wall section of a cylinder body in U.S. Pat. No. 2,711,000.

By restricting and limiting the expansion or flexibility of only a portion of the bell body, as evidenced by the prior art, the prior art devices created unsupported localized stress, that by reason of the wet weight of the cementitious material, soon ruptured, bent or broke all or parts of the expanding parts of those devices, rendering a void in the placement and packing of the lining material against the pipe to be lined.

It is an object of this invention to eliminate the problems and structural defects of the prior art.

SUMMARY OF THE INVENTION

In lining chimeny pipes with a cementitious material, it is desirable to apply a uniform thickness of such material under compacting to the interior surface of the pipe. A This uniform thickness assures a proper dehydration of the material and its resulting adhesiveness to the interior surface.

To achieve the above, the outer diameter of the slip must conform to the inner diameter of the pipe to be lined, providing the proper clearance therebetween, for the deposit of the cementitious material upon the existing pipe surface.

Thus it is an object of the invention to provide a slip construction that will permit the circumferential adjustment of its body to the required inner diameter of the pipe to be lined, without affecting the functions of the compacting vibrational mechanism within the body.

Another object of this invention is to provide a means for detecting the proper amount of lining mixture to be present at the forward end of the apparatus to assure proper lining conditions. This means comprises a pair of internal switches having exposed actuators which respond to depressing contact of a yieldably supported cap-like member.

A further object of this invention is to provide an internal rearwardly focused light that will illuminate the finished lining condition of the pipe immediately downstream of the apparatus's operation.

Still another object of this invention is to provide a reduced inwardly directed tapered trailing edge which would permit the apparatus to be retracted in the chimney to be lined when it is found to be necessary to reline a section once the apparatus has passed therebeyond.

Yet another object of this invention is to provide a pipe lining apparatus which is more durable, economical efficient than prior known lining machines of this type.

The above and other object and advantages of the present invention will appear more fully hereinafter from a consideration of the detailed description which follows.

BRIEF DESCRIPTION OF THE DRAWINGS

This invention will be best understood by reference to the accompanying drawings which illustrate the preferred construction and arrangement of parts by which the objects of this invention are achieved, and in which.

GENERAL DESCRIPTION

Figure 1:
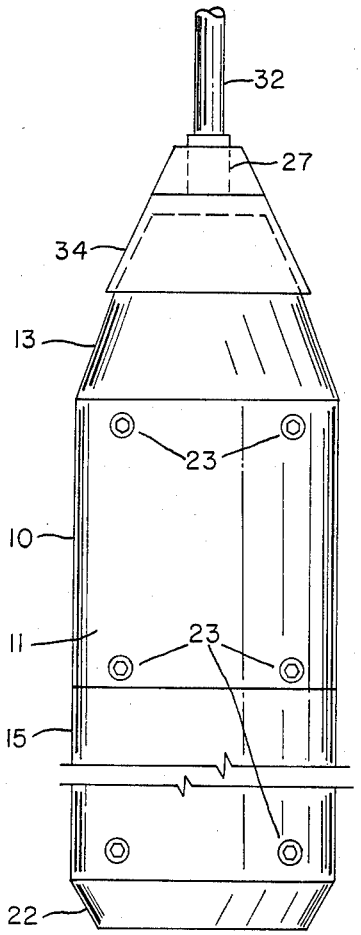
FIG. 1 is a side elevational view of the chimney lining slip form of this invention.

Referring to FIG. 1 there is shown the improved chimney lining slip form comprising a generally hollow circular body 10 comprising two complimentary bell sections 11 and 12. At the foward end of the body 10 are two complimentary cone sections 13 and 14, while at the trailing end there are two complimentary tail sections 15 1nd 16.

Figure 2:
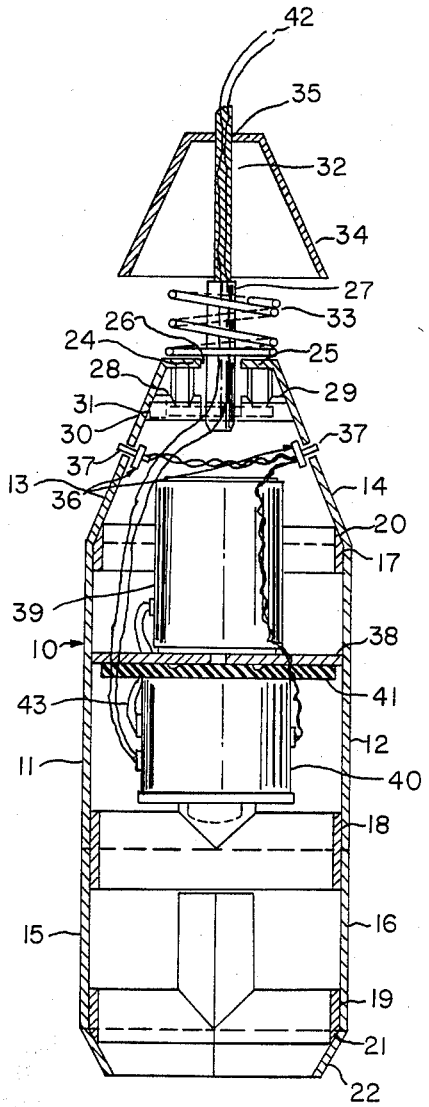
FIG. 2 is side elevational detailed sectional view of the chimney lining slip form of this invention.

As illustrated in FIG. 2 each of the sections forming the body 10 are provided with internally positioned ring-shaped bolt flanges 17, 18 and 19. It should be noted that the bolt flange 17 provides an outer partially tapered edge portion 20 corresponding to the inclination of the interior walls of the cone sections 13 and 14. Likewise the rear flage 19 provides a partially tapered outer peripheral wall which mates with the inwardly trailing tail section 22 of the body 10. It is proposed that these bolt flanges 17, 18 and 19 be welded to one section and be provided with threaded apertures which will receive suitable connecting bolts 23.

Each of the cone sections 13 and 14 provide a partial truncated top wall 24 and 25. The confronting edges of which are correspondingly semi-circularly notched to provide an opening 26 through which extends a cable connecting eyelet 27.

As illustrated in FIG. 2 the cone section 13 provides a bolt guide 28 which is in longitudinal alignment with an internally threaded bolt receiving sleeve 29 carried on the inner wall of the cone section 14. Through an appropriate opening 30 formed in the wall of the cone section 13 and which is in alignment with the bolt guide 28 a connecting bolt 31 may pass through the cable eyelet 27 and be threaded into the bolt sleeve 29. By this arrangement the body 10 is removably connected to the lifting cable 32.

Adapted to be seated upon the truncated top walls 24 and 25 are the base coils of an expansion spring 33. This spring 33 is adapted to encircle the cable eyelet 27 and to function to yieldably space a hollow cup-like cap 34 off of the forward end of the cone sections 13 and 14 of the body 10. As clearly illustrated the cap 34 is provided with a center opening 35 which freely and slidably receives both the cable 32 and the cable eyelet 27.

Adjacent to the upper ends of the cone sections 13 and 14 and interiorly thereof there is provided a pair of push button switches 36. Each of the switches provides an exposed actuator 37 which protrudes out of suitable openings formed in the wall sections as shown. These switches are adapted to be activated when their respective switch actuators 37 are depressed by their contact with the internal tapered wall surfaces of the cap 34 when the appartus is in operation as hereinafter described.

Each of the bell sections 11 and 12 provide internal shelves 38 which form a base for a vibrator 39 as well as a support for the electrical control housing 40. A vibrator pad 41 is mounted on these shelves and functions to maintain the vibrator 39 and housing 40 in a stable position within the body 10. The electrical housing 40 provides a electrical source cable 42, and there is provided a electrical source cable 43 between the electrical housing 40 and the vibrator 39. While the electrical supply cable 42 is illustrated as extending out of the open trailing end of the body 10 it may be designed so as to exit out of the top as well.

Carried by the electrical housing 40 is a focused light. This light will be focused so as to project out of the open trailing end of the body 10 so as to provide illumination upon the finished lining applied by the apparatus.

Figure 3:
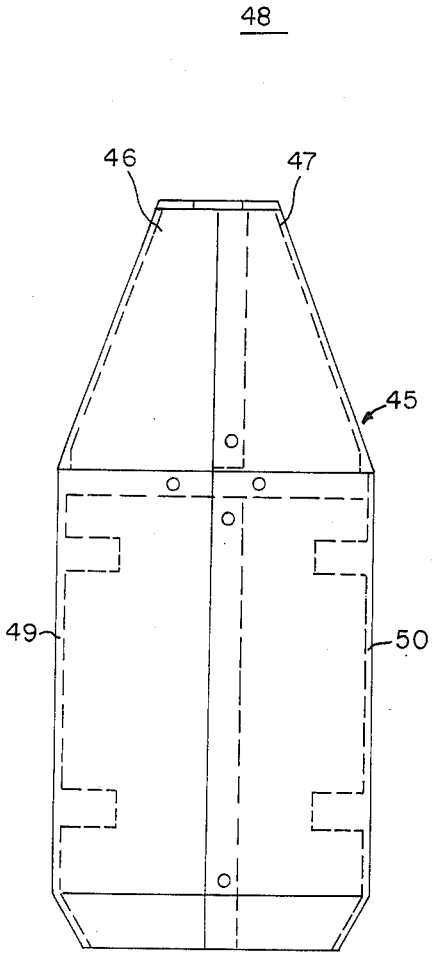
FIG. 3 is a side elevational view of a modified form of this invention.
Figure 4:
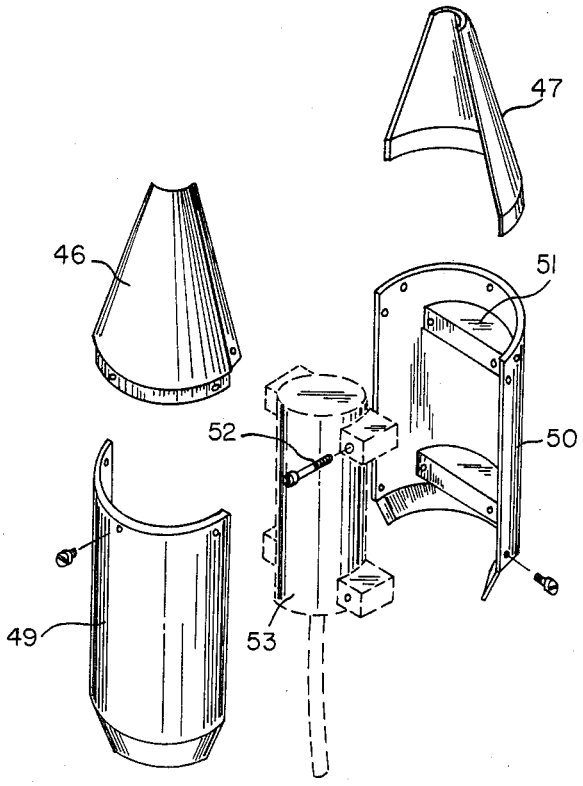
FIG. 4 is a perspective view of the respective parts of the apparatus of FIG. 3 shown in exploded relation and, FIG. 5 is a perspective view of the apparatus of FIG. 3 including expansion panels all shown in exploded relationship.

Referring to the construction of the modified lining apparatus 45 of FIG. 3 it is shown that the cone sections 46 and 47 are formed to provide connecting rings 48 to which the lifting cable can be attached. The bell sections 49 and 50 provide internal braces 51 to which, by means of bolts 52, a vibrator 53 is attached.

As each chimney to be lined provides varying internal dimensions it is desirable to be able to vary the diameter of the chimney liner to meet such requirements. To accomplish this I have provided additional expansion panels ranging in various widths.

Figure 5:
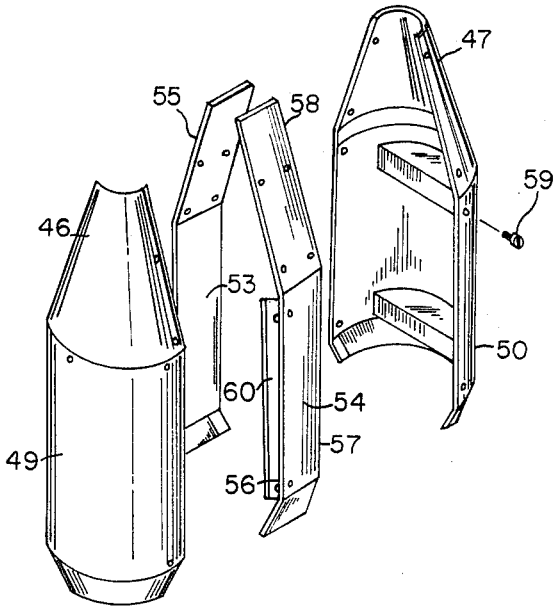

Referring to FIG. 5 there is illustrated expansion panels 53 and 54, including cone expansion panels 55 and 58. In this construction these expanding panel's sides 56 and 57 as well as the corresonding side edges of the bell panels 49 and 50 will mate and overlay a connecting strip 60 (only one shown), and be bolted together by connectors 59.

It is to be understood that the sectional construction of the apparatus as shown in FIGS. 1 and 2 may be likewise expanded along their confronting longitudinal edges.

In operation the apparatus 10 is suspended by cable 32 within the lower portion of the chimney or pipe to be lined. The cementitious material known in the trade as "mud" is poured down upon the apparatus with the weight thereof forcing the cap 34 to compress the spring 33 so that the cap 34 engages and actuates the switch actuators 37. These switches will signal the presence of the mud in sufficient quantity to commence the lining operation. They may also function to actuate the vibrator 39.

As the mud is dispensed about the cone sections 13 and 14 it is caused to pass in the space between the body 10 and the interior chimney wall which is to be lined. The action of the vibrator 39 will effect even distribution of the mud and compact it against the chimney wall. In the event of an insufficient quantity of mud the spring 33 will expand and move the cap 34 off the switch actuators 37 which in turn will alert the operator, through an alarm (not shown), electrically connected to one of the switches 36 of the situation.

As the apparatus 10 is drawn through the chimney or pipe to be lined the rearwardly focused light 44 will illuminate the completed work area so that a visual inspection can be readily made. In the event that a repeated application is required the apparatus 10 may be lowered by the cable 32 to the area to be repaired. The reverse movement will be guided by the tapered trailing edge 22 which will prevent gouging or displacement of the packed mud lining.

From the foregoing it is apparent that I have provided a novel construction for a lining apparatus which is highly efficient in use, economical in manufacture amd readily adaptable to varying internal demensions.

While have illustrated and described the preferred form of constuction for carrying my invention into effect, this is capable of variation and modification without departing from the spirit of the invention. I therefore do not wish to be limited to the precise details of construction as set forth, but desire to avail myself of such variations and modification as come within the scope of the appended claims.

Having thus described my invention what I claim as new and desire to protect by Letters Patent is:

1. An apparatus for lining pipes with cementitious material comprising:

(a) a longitudinally split hollow circular body having a concical leading cone and an inwardly tapered trailing edge, (b) means connecting the portions of said body, cone and trailing edge along their longitudinal split into a unitary structure, (c) a movable cap member positioned over the said conically shaped leading cone, (d) means yieldably spacing said cap member from said cone along a longitudinal line, (e) a vibrator carried within said body for distributing the cementitious material about the apparatus as the material is poured over said cap, and (f) actuating means carried by said cone and operable by said cap as said cap is yieldably forced by the cementitious material upon said cone to actuate said vibrator.

2. An apparatus for lining pipes as defined by claim 1 wherein said means connecting the portions of said body, cone and trailing edge along their longitudinal split comprises flanges extending between mating edge of each split portion, adapted to receive connectors for joining said split portions into a unitary structure.

3. An apparatus for lining pipes as defined by claim 2 and including means cooperating with said flanges and disposed between the mating edges of said body, cone and trailing edge for expanding the dimension of the apparatus.

4. An apparatus for lining pipes as defined by claim 3 wherein said means for expanding the dimensions of the apparatus consists of panel-like members having substantially identical configurations to the respective body, cone and trailing edge.

5. An apparatus for lining pipes as defined by claim 2 wherein said means yieldably spacing said movable cap member from said cone comprises an expansion spring.

6. An apparatus for lining pipes as defined by claim 2 wherein said actuating means comprises a series of push-button type switches, with said switches providing actuators extending beyond said cone and adapted to be in contact with said cap member.

7. An apparatus for lining pipes as defined by claim 1 wherein said means yieldably spacing said movable cap member from said cone comprises an expansion spring.

8. An apparatus for lining pipes as defined by claim 1 wherein said actuating means comprises a series of push-button type switches, with said switches providing actuators extending beyond said cone and adapted to be in contact with said cap member.

9. An apparatus for lining pipes as defined by claim 1 and including means for expanding the dimensions of said body, cone and trailing edge of the apparatus.

10. An apparatus for lining pipes as defined by claim 9 wherein said means for expanding the dimensions of the apparatus consists of panel-like members having substantially identical configurations to the respective body, cone and trailing edge.

11. An apparatus for lining pipes as defined by claim 9 and including a source of illumination directed outwardly of said tapered trailing edge to illuminated the pipe lined by the apparatus.

12. An apparatus for lining pipes as defined by claim 1 and including a source of illumination directed outwardly of said tapered trailing edge to illuminate the pipe lined by the apparatus.

* * * * *